US007419012B2

(12) United States Patent
Lynch

(10) Patent No.: US 7,419,012 B2
(45) Date of Patent: Sep. 2, 2008

(54) WELLBORE TOP DRIVE SYSTEMS

(75) Inventor: James Edward Lynch, Terrell, TX (US)

(73) Assignee: Varco I/P, Inc., Houston, TX (US)

( * ) Notice: Subject to any disclaimer, the term of this patent is extended or adjusted under 35 U.S.C. 154(b) by 0 days.

(21) Appl. No.: 11/588,862

(22) Filed: Oct. 26, 2006

(65) Prior Publication Data

US 2008/0099221 A1 May 1, 2008

(51) Int. Cl.
*B23Q 5/00* (2006.01)

(52) U.S. Cl. ..... 173/152; 166/77.1; 166/77.51; 175/218; 137/515

(58) Field of Classification Search ..... 173/152, 173/218, 317; 175/214, 218; 166/77.1, 77.51, 166/85.1, 85.3, 86.1, 325; 137/515, 515.3, 137/515.7
See application file for complete search history.

(56) References Cited

U.S. PATENT DOCUMENTS

| | | | | |
|---|---|---|---|---|
| 2,225,208 | A | 12/1940 | Crickmer | |
| 2,473,046 | A | 6/1949 | Adams, Jr. | |
| 3,078,108 | A | 2/1963 | Smith | |
| 3,142,498 | A | 7/1964 | Press | |
| 3,183,684 | A * | 5/1965 | Zeidler | 464/8 |
| 3,517,952 | A | 6/1970 | McCracken | |
| 4,438,954 | A | 3/1984 | Hattori | 285/104 |
| 4,535,852 | A | 8/1985 | Boyadjieff et al. | 175/170 |
| 4,606,656 | A | 8/1986 | LaRou | 384/475 |
| 4,749,192 | A | 6/1988 | Howeth | 285/86 |
| 4,768,813 | A | 9/1988 | Timmons | 285/373 |
| 4,813,493 | A | 3/1989 | Shaw et al. | 173/164 |
| 4,900,063 | A | 2/1990 | Baarfusser et al. | 285/24 |
| 5,246,257 | A | 9/1993 | Kojima et al. | 285/112 |
| 5,286,135 | A | 2/1994 | James | 403/405.1 |
| 5,562,313 | A | 10/1996 | Piniaev et al. | 285/373 |
| 5,806,563 | A | 9/1998 | Rabby | 137/613 |
| 6,183,766 | B1 * | 2/2001 | Sine et al. | 424/405 |
| 6,220,363 | B1 * | 4/2001 | Dallas | 166/382 |
| 6,276,450 | B1 | 8/2001 | Seneviratne | 166/85.1 |
| 6,289,993 | B1 * | 9/2001 | Dallas | 166/386 |
| 6,408,885 | B2 | 6/2002 | Hillis | 137/883 |
| 6,625,393 | B2 | 9/2003 | Eller et al. | 392/489 |
| 6,769,720 | B2 | 8/2004 | Dahms et al. | 285/308 |
| 6,808,455 | B1 * | 10/2004 | Solorenko et al. | 464/20 |
| 7,017,671 | B2 | 3/2006 | Williford | 166/386 |
| 7,108,081 | B2 | 9/2006 | Boyadjieff | 175/40 |
| 7,121,295 | B2 | 10/2006 | Seneviratne et al. | 137/375 |
| 7,159,652 | B2 * | 1/2007 | McGuire et al. | 166/85.1 |
| 2004/0026129 | A1 * | 2/2004 | Downie et al. | 175/106 |
| 2005/0082829 | A1 * | 4/2005 | Dallas | 285/354 |
| 2005/0236191 | A1 | 10/2005 | Hu | 175/218 |
| 2007/0251705 | A1 * | 11/2007 | Wells et al. | 166/387 |

* cited by examiner

*Primary Examiner*—Thanh K Truong
(74) *Attorney, Agent, or Firm*—Guy McClung

(57) ABSTRACT

A drive system for wellbore operations, the drive system, in certain, but not necessarily all aspects, including a main body, a motor apparatus, a main shaft extending from the main body and rotatable by the motor, the main shaft having a top end and a bottom end, and an item, the item non-threadedly connected to the main shaft.

13 Claims, 6 Drawing Sheets

FIG. 4A
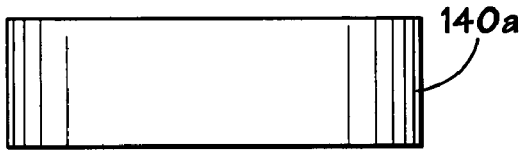
FIG. 4B
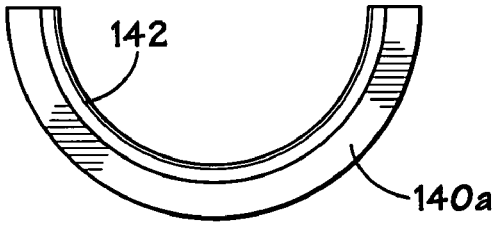
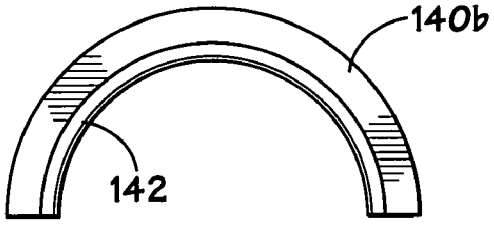
FIG. 4C
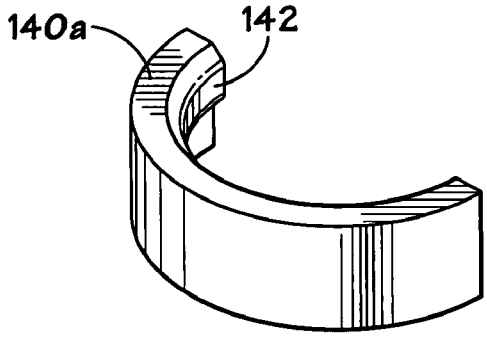
FIG. 4D
FIG. 5B
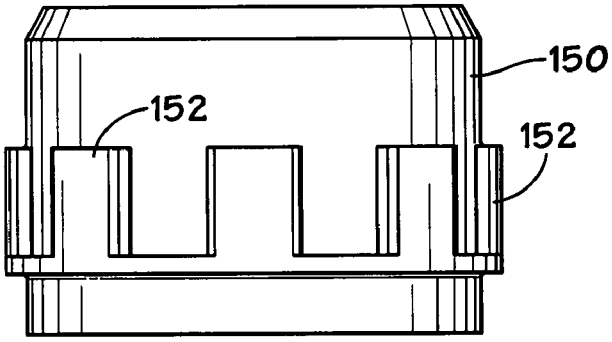
FIG. 5A
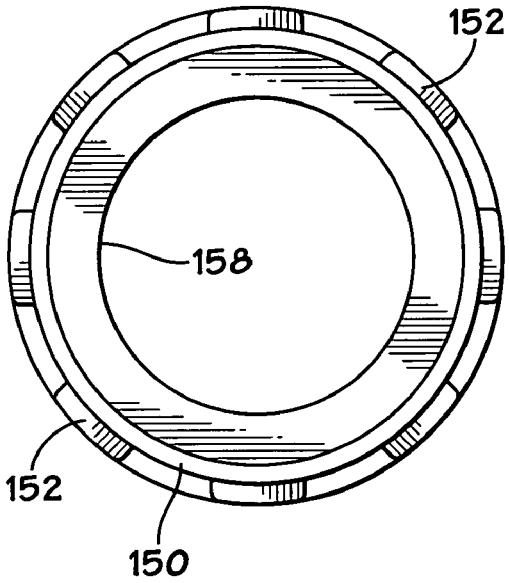

WELLBORE TOP DRIVE SYSTEMS

BACKGROUND OF THE INVENTION

1. Field of the Invention

This invention is directed to wellbore drilling top drive systems and methods of use; parts thereof; and, in certain particular aspects, such systems with a top drive stem that is not threadedly mated to an item connected thereto.

2. Description of Related Art

The prior art discloses a variety of top drive systems; for example, and not by way of limitation, the following U.S. patents present exemplary top drive systems and components thereof: U.S. Pat. Nos. 4,458,768; 4,807,890; 4,984,641; 5,433,279; 6,276,450; 4,813,493; 6,705,405; 4,800,968; 4,878,546; 4,872,577; 4,753,300; 6,007,105; 6,536,520; 6,679,333; 6,923,254—all these patents incorporated fully herein for all purposes.

Certain typical prior art top drive drilling systems have a derrick supporting a top drive which rotates tubulars, e.g., drill pipe. The top drive is supported from a travelling block beneath a crown block. A drawworks on a rig floor raises and lowers the top drive. The top drive moves on a guide track.

In many typical prior art top drive systems the top drive includes a drive shaft or "stem" that is threadedly connected to an item below it, e.g. a mud saver apparatus or an upper internal blowout preventer. Improper handling or enormous stresses can damage the threads on the end of the drive stem or shaft. Such damage can result in personal injuries, costly down time for the rig, and expensive replacement or repair of the drive stem.

In certain prior art systems, a standard method of attachment for connecting the drilling pipe to a shaft, stem, power swivel or standard swivel, is a threaded connection with a shoulder. The nature of threads is such that the stress at the root of the thread is high and often the thread is difficult to inspect for cracks. As drilling loads increase (e.g., because the search for oil has gone deeper and deeper in the earth), stresses in the threads of the tool joint increase as well. Because of the nature of drilling rigs, including those which drill while floating off shore, there is sometimes a dynamic misalignment between the drive shaft and the drilling pipe, which induces a moment into the threaded connection in addition to the pressure, the drilling torque, and the support of the drill pipe assembly. Because the drive shaft is rotating at the time of the misalignment, there is an opportunity for the accumulation of fatigue damage. This, if severe enough, will result in the initiation and propagation of a fatigue crack. This can result in the failure of the tool joint. A failure of the part occurs when a fatigue crack has propagated to the outside of the shaft. Once a failure occurs the rig is shut down to repair the failed part. This represents lost income by reason of delays in production and lost billable contractor hours.

Often drilling fluid is conducted through a drill stem requiring a seal or seals between the drill stem and an item (e.g. an upper internal blowout preventer) to which the drill stem is connected.

There is a need for a more robust connection to the drive shaft or stem of a top drive, swivel or power swivel, one less sensitive to fatigue and easier to inspect. There is a need for an effective structure for sealing an interface between a drive stem and an item to which it is connected. There is a need for an effective structure for transmitting torque from a drive stem to items below it.

BRIEF SUMMARY OF THE INVENTION

The present invention, in certain aspects, provides a top drive system for wellbore operations, the top drive system including: a main body; a motor apparatus (e.g. one motor, or two or more stacked or spaced-apart motors); a motor drive shaft (or stem) extending from the main body, the drive shaft having a top end and a bottom end, the bottom end having no threads; a connection assembly which provides a non-threaded connection between the drive shaft and another item; and, in certain aspects, an item (e.g., but not limited to, a mud saver system, an upper internal blowout preventer, a cross over thread adapter, a saver sub, a misalignment coupling), the item non-threadedly connected to the drive shaft with the connection assembly.

In one particular aspect, the drive shaft of the top drive motor is connected to a drive stem and it is this stem that is non-threadedly connected to another item. In certain aspects, this other item is an upper internal blowout preventer that is non-threadedly connected to the stem.

In certain particular aspects, a connection assembly according to the present invention has a load ring adjacent a corresponding recess in a drive shaft or a drill stem and the load ring is held in place by a load housing. The load housing is threaded to threadedly mate with another item below it. The load connected beneath the drill shaft or stem passes through the load housing and through the load ring. Thread damage, if it occurs, occurs in the threads of the load housing which is relatively easily removed and replaced at much less expense as compared to removing the shaft or stem and replacing or repairing the shaft or stem.

In certain aspects, a second connection assembly according to the present invention held in reserve allows the immediate replacement of a connection assembly on site, thereby reducing the costs of rig downtime by reason of a quick replacement. The original connection assembly may then be cleaned and inspected at a convenient pace (repaired if necessary) and set aside for the next field swapout replacement once structural integrity is confirmed.

The present invention discloses, in at least certain aspects, a drive system for wellbore operations, the drive system having: a main body; a motor apparatus; a main shaft extending from the main body and rotatable by the motor, the main shaft having a top end and a bottom end; and an item, the item adjacent to the bottom end of the main shaft and non-threadedly connected to the main shaft.

The present invention discloses, in at least certain aspects, a top drive system (e.g. top drive or power swivel) for wellbore operations, the top drive system having: a main body; a motor apparatus; a main shaft extending from the main body and rotatable by the motor, the main shaft having a top end and a bottom end; an item, the item non-threadedly connected to the main shaft, e.g., but not limited to, via exterior threading on the item. Optionally, such a system has a connection assembly for non-threadedly connecting the main shaft to the item, the connection assembly having: a load ring with a projection projecting interiorly of the load ring; a load ring housing; the main shaft having a recess therearound corresponding to the load ring's projection, the projection disposed within the recess; the load ring housing threadably connectable to an item below the main shaft and the load ring housing adjacent and encompassing the load ring to maintain the load ring in position with respect to the main shaft, the load ring housing has a lower end with interior threading for threadedly mating with the exterior threading of the item. Optionally, any such system may include a series of spaced-apart torque transmitting splines on the lower end of the main shaft for engaging a series of corresponding splines on the item.

The present invention discloses, in at least certain aspects, a method for connecting a drive shaft of a wellbore operations drive system to an item, the method including: positioning the drive shaft of a drive system above an item, the drive system comprising a main body, a motor apparatus, a main shaft extending from the main body and rotatable by the motor, the main shaft having a top end and a bottom end, and an item, the item non-threadedly connectable to the main shaft; and connecting the drive shaft non-threadedly to the item.

The present invention discloses, in at least certain aspects, a top drive shaft useful in wellbore operations, the top drive shaft having: a body having a bottom, a top, an exterior, and a fluid flow bore therethrough from top to bottom; a load recess in the exterior of the body; the load recess disposed for reception of a load member; the load member releasably securable in the load recess, e.g., but not limited to, by a housing, the housing connectable to an item to be positioned below and supported by the top drive shaft.

Accordingly, the present invention includes features and advantages which are believed to enable it to advance drilling technology. Characteristics and advantages of the present invention described above and additional features and benefits will be readily apparent to those skilled in the art upon consideration of the following detailed description of preferred embodiments and referring to the accompanying drawings.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

What follows are some of, but not all, the objects of this invention. In addition to the specific objects stated below for at least certain preferred embodiments of the invention, there are other objects and purposes which will be readily apparent to one of skill in this art who has the benefit of this invention's teachings and disclosures. It is, therefore, an object of at least certain preferred embodiments of the present invention to provide:

New, useful, unique, efficient, non-obvious top drive systems, components and parts thereof, and methods of their use;

Such systems with a non-threaded shaft or stem connection between a drive shaft or stem and an item below it;

Such systems with a connection assembly for non-threadedly connecting a drive shaft or stem to an item therebelow, the connection assembly including a load ring partially disposed in a recess in the drive shaft or stem and a removable housing that holds the load ring in place so that the load ring supports the weight of items connected below the shaft or stem, including, but not limited to, the weight of a drillstring below the stem;

Such systems which effectively seal an interface between the drive shaft or stem and an item below the shaft or stem; and Such systems transmit rotation to items below a drive shaft or stem with a lower, non-threaded end.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, various purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later attempt to disguise it by variations in form or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention or of the claims in any way.

It will be understood that the various embodiments of the present invention may include one, some, or all of the disclosed, described, and/or enumerated improvements and/or technical advantages and/or elements in claims to this invention.

BRIEF DESCRIPTION OF THE SEVERAL VIEWS OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or equivalent embodiments.

FIG. 4A is a side view of the load ring shown in FIGS. 2A and 2B.

FIG. 4B is a top view of the load ring of FIG. 4A.

FIG. 4C is a bottom view of the load ring of FIG. 4A.

FIG. 4D is a top perspective view of the load ring of FIG. 4A.

FIG. 5A is a side view of the load ring housing shown in FIGS. 2A and 2B.

FIG. 5B is a top view of the load ring housing of FIG. 5A.

Figure 2A:
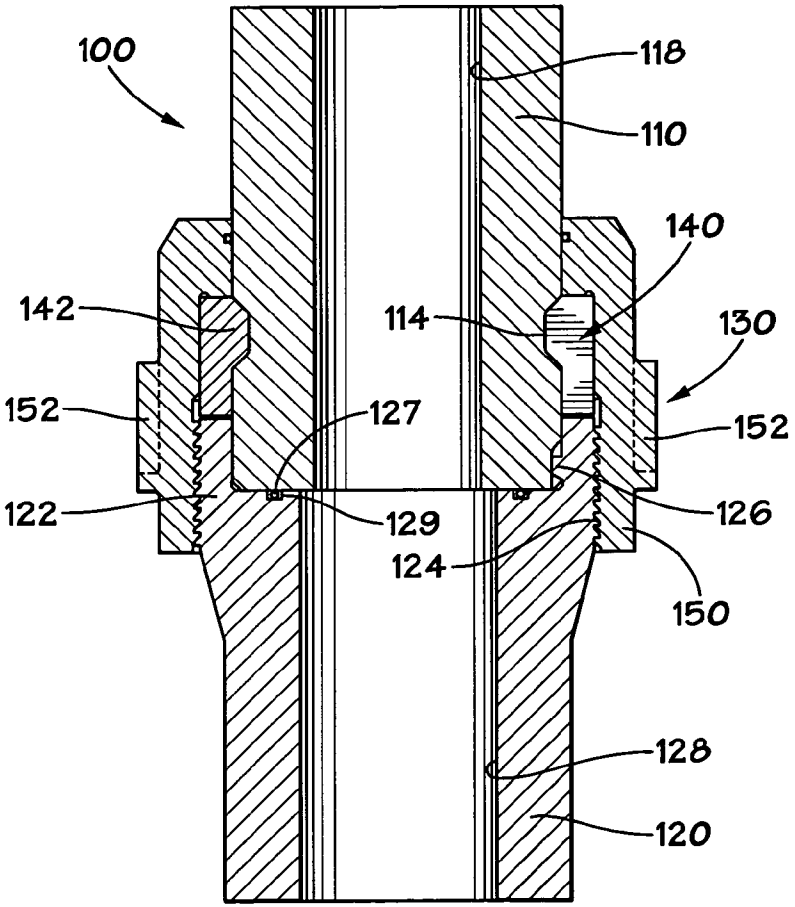
FIG. 2A is a side cross-section view of a top drive stem according to the present invention and of a top drive stem connection system according to the present invention.

Presently preferred embodiments of the invention are shown in the above-identified figures and described in detail below. It should be understood that the appended drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiments, and are not intended to mean the claimed invention of any particular appended claim(s) or all of the appended claims. Accordingly, the subject or topic of each such reference is not automatically or necessarily part of, or required by, any particular claim(s) merely because of such reference.

DETAILED DESCRIPTION OF THE INVENTION

Figure 1:
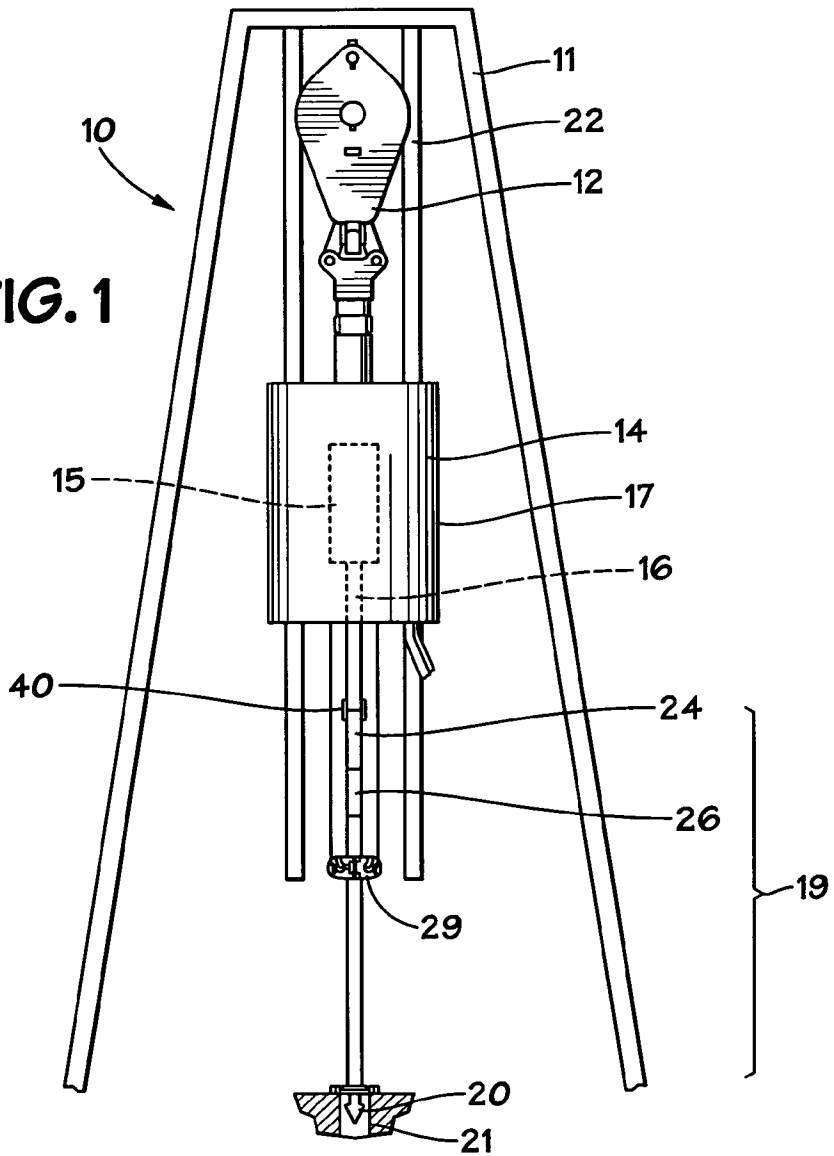
FIG. 1 is a schematic view of a top drive drilling system according to the present invention.
Figure 2B:
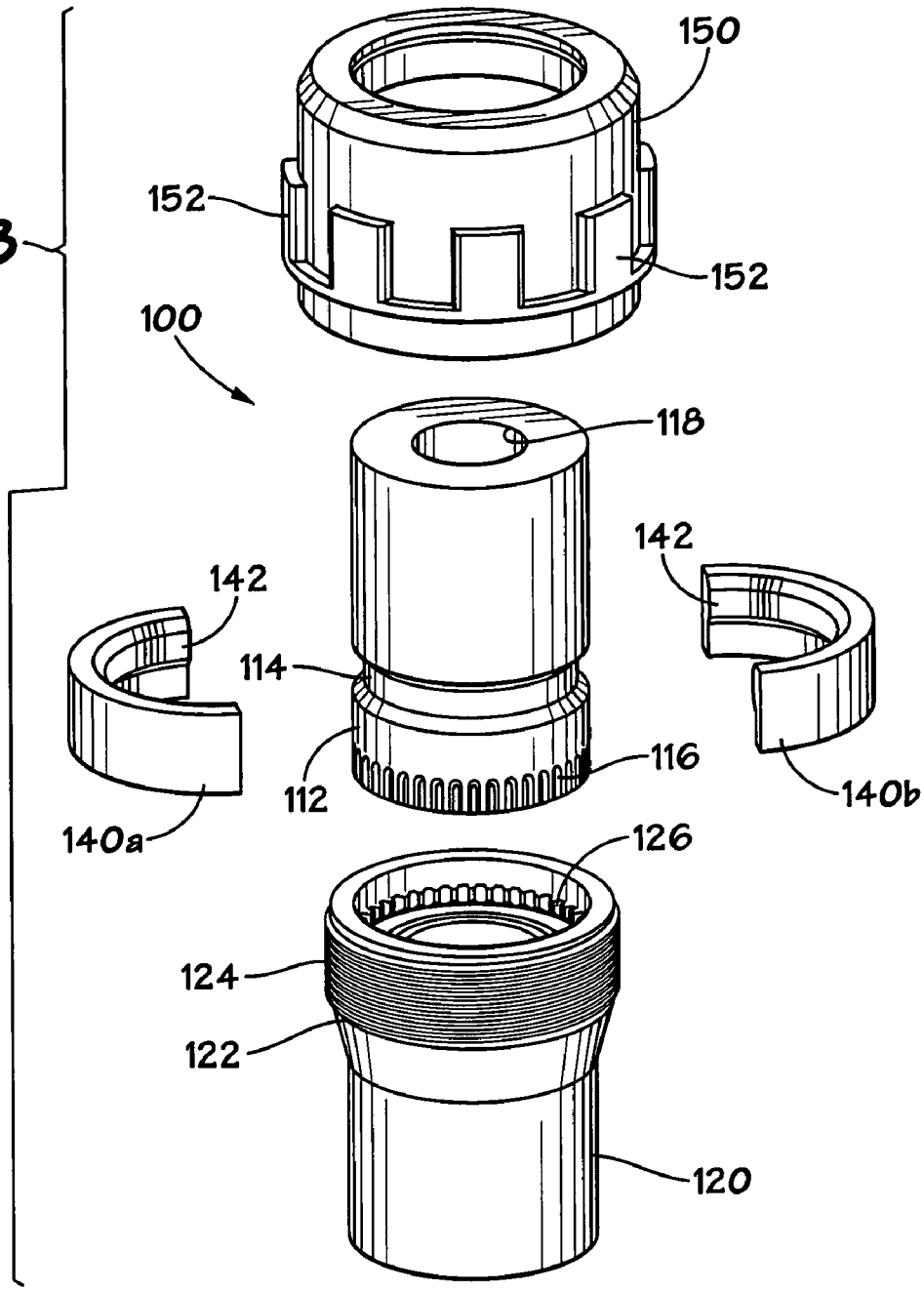
FIG. 2B is an exploded view of the stem and system of FIG. 2A.
Figure 3B:
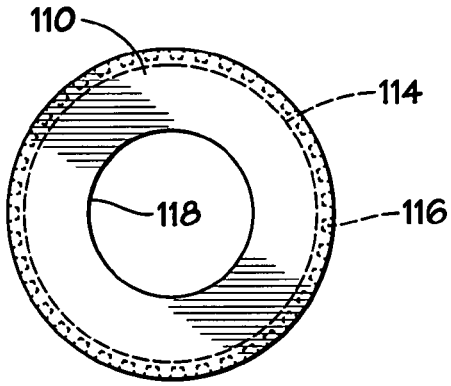
FIG. 3B is a top view of the stem FIG. 3A.
Figure 3A:
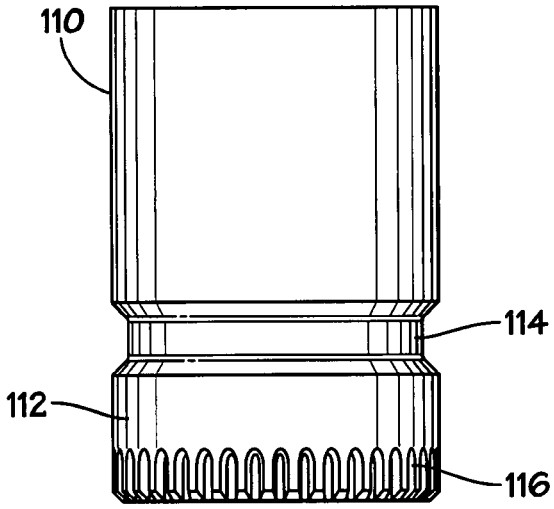
FIG. 3A is a side view of the stem shown in FIGS. 2A and 2B.
Figure 3D:
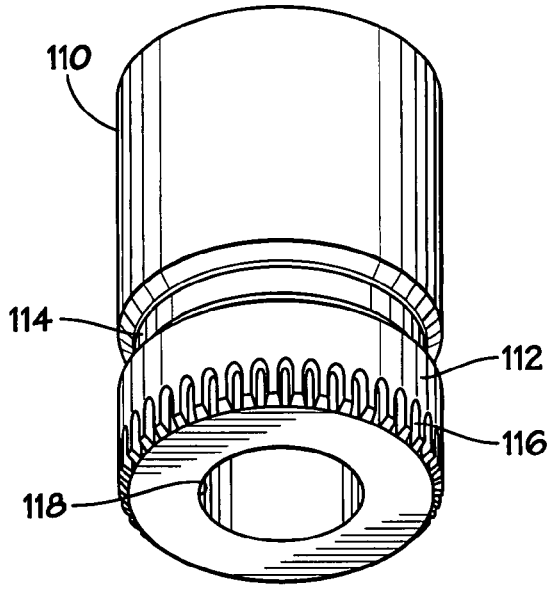
FIG. 3D is a bottom perspective view of the stem of FIG. 3A.
Figure 3C:
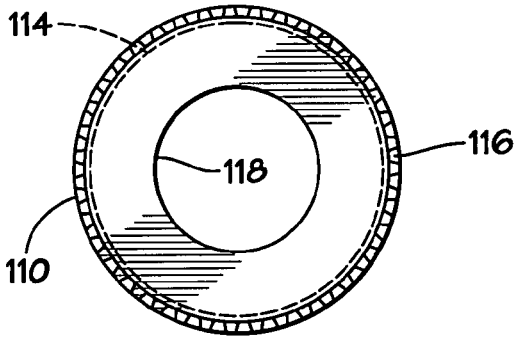
FIG. 3C is a bottom view of the stem of FIG. 3A.
Figure 6B:
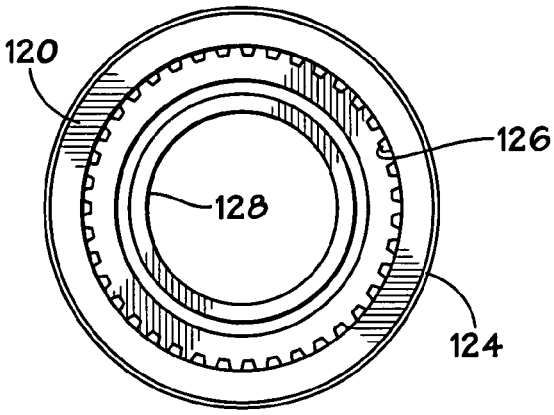
FIG. 6B is a top view of the upper internal blowout preventer of FIG. 6A.
Figure 6A:
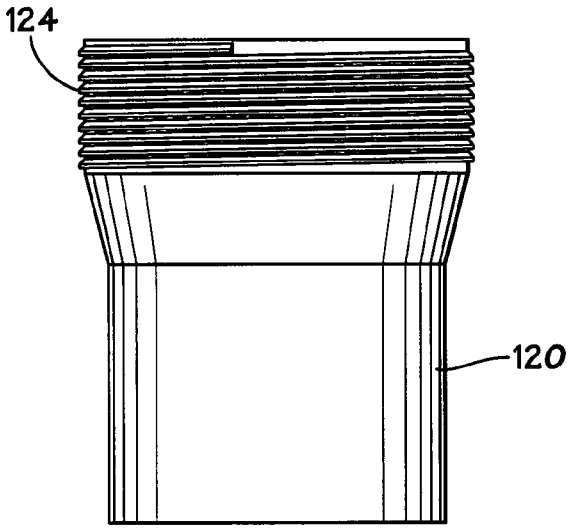
FIG. 6A is a side view of the upper internal blowout preventer shown in FIGS. 2A and 2B.
Figure 6D:
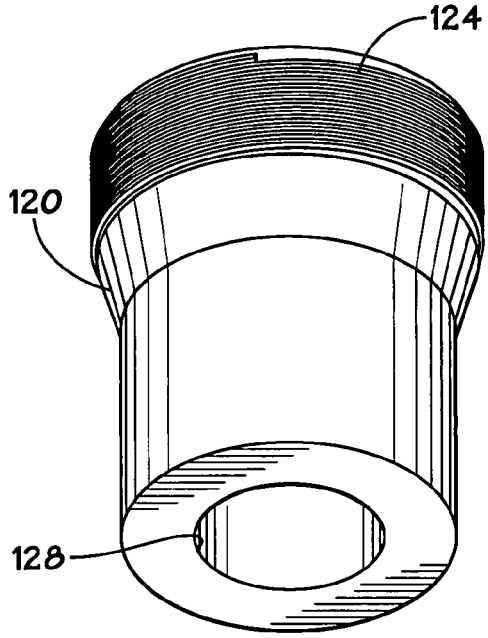
FIG. 6D is a perspective view of the upper internal blowout preventer of FIG. 6A.
Figure 6C:
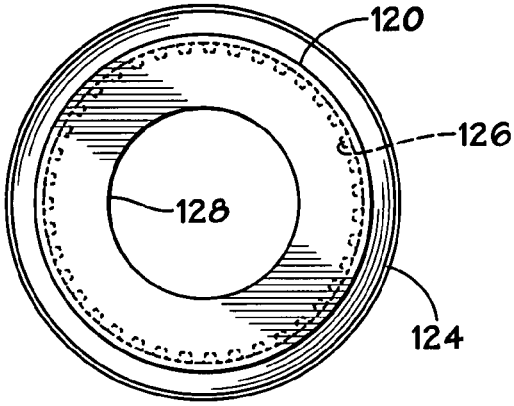
FIG. 6C is a bottom view of the upper internal blowout preventer of FIG. 6A.

FIG. 1 illustrates a top drive system 10 according to the present invention which is structurally supported by a derrick 11. The system 10 has a plurality of components including: a top drive 14, (shown schematically) a main shaft 16, a housing 17, a drillstring 19 and a drill bit 20. The components are collectively suspended from a traveling block 12 that allows them to move upwardly and downwardly on rails 22 connected to the derrick 11 for guiding the vertical motion of the components. Reactance to torque generated during operations with the top drive or its components (e.g. during drilling) is transmitted through a movable dolly or other support (not shown) to the derrick 11.

The main shaft 16 extends through the motor housing 17 and connects to items below the shaft ("stem" or "shaft"—"stem" can include stems and shafts). The shaft 26 is non-threadedly connected to an upper end of an IBOP assembly 24 which is the first in a series of items and/or tubular members collectively referred to as the drillstring 19. An opposite end of the drillstring 19 is threadedly connected to a drill bit 20.

During operation, a motor apparatus 15 (shown schematically) encased within the housing 17 rotates the main shaft 16 which, in turn, rotates the drillstring 19 and the drill bit 20. Rotation of the drill bit 20 produces an earth bore 21. Fluid pumped into the top drive system passes through the main shaft 16, the drill stem 18, the drillstring 19, the drill bit 20 and enters the bottom of the earth bore 21. Cuttings removed by the drill bit 20 are cleared from the bottom of the earth bore 21 as the pumped fluid passes out of the earth bore 21 up through an annulus formed by the outer surface of the drill bit 20 and the walls of the bore 21. A typical elevator 29 is suspended from the top drive system.

A variety of items can be connected to and below the main shaft 16; for example, and not by way of limitation, the items shown schematically as items 24 and 26 which, in certain aspects, and not by way of limitation, may be an upper internal blowout preventer 24 and a lower internal blowout preventer 26. In other systems according to the present invention the item 24 is a mud saver apparatus, a load measuring device, a flexible sub, or a saver sub.

A connection assembly 40 (any according to the present invention) non-threadedly connects the item 24 to the main shaft 16. The shaft 16 may be a drill stem or a quill.

FIGS. 2A-6D illustrate a system 100 according to the present invention for non-threaded connection of a drill stem (driven by a motor of, e.g., a top drive) to another item, e.g. a mud saver system or upper internal blowout preventer.

The system 100 has a drill stem 110 non-threadedly connected to an upper internal blowout preventer 120 with a connection assembly 130 that has a load ring 140 and a load ring housing 150. The load ring 140 includes, in one aspect, two halves 140*a*, 140*b*.

The drill stem 110, which may be any suitable length, has a lower end 112 above which is a circumferential recess 114. A series of spaced-apart splines 116 project out from the lower end 112 of the drill stem 110. A fluid flow bore 118 extends from the top to the bottom of the drill stem 110.

The upper internal blowout preventer 120 has an upper end 122 with threads 124 and a series of spaced-apart splines 126 which mate with the splines 116 of the drill stem 110 to transfer torque from the drill stem 110 to the upper internal blowout preventer 120. A fluid flow bore 128 extends from the top to the bottom of the upper internal blowout preventer 120 and is in fluid communication with the bore 118. A seal 127 in a recess 129 seals the upper-internal-blowout-preventer/drill-stem interface. The recess 129 is an upwardly-facing recess and the seal 127 abuts a lower horizontal end surface (as viewed in FIG. 2A) of the drill stem 110. The seal 127 prevents the leakage of fluid flowing through the upper internal blowout preventer and through the drill stem. Of course, the recess may be on the end of the drive stem and the seal may project down to sealingly contact an item connected to the drive stem.

The load ring 140 has a projection 142 projecting inwardly from a body 144 of the load ring 140. The load ring projection 142 (half of which is on each load ring half 140*a*, 140*b*) projects into the recess 114 of the drill stem 110.

The projection 142 is held in the recess 114 by the load ring housing 150 which has interior threads 152 for threadedly mating with the threads 124 of the upper internal blowout preventer 120 to connect the load ring housing 150 to the upper internal blowout preventer 120 and to maintain the load ring 140 in place. Loads below the drill stem 110 are transferred to the load ring housing 150, from it to the load ring 140, and from the load ring 140 to the drill stem 110, thus bypassing a lower part of the drill stem 110. A bore 158 extends through the load ring housing 150 to accommodate the drill stem 110. Wrench flats 152 project out from the housing 150.

Figure 7:
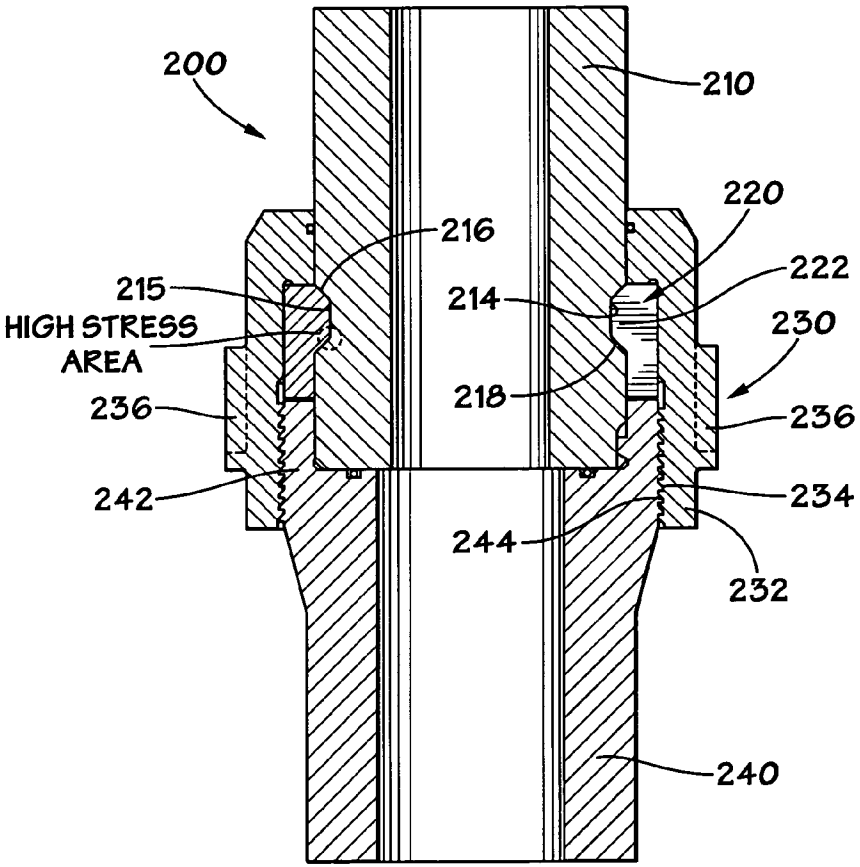
FIG. 7 is a side cross-section view of a connection according to the present invention.

FIG. 7 shows a system 200 according to the present invention (like the system 100) which includes a driven shaft, a top drive stem 210, having a lower end 212 with a groove 214 having a groove wall 215, an upper fillet 216, and a lower fillet 218. The lower fillet 218 has a radius that is relatively larger than a typical radius of a thread on certain threaded prior art top drive stems. This lower fillet can withstand stresses higher than those which a typical threaded top drive stem can withstand.

A load ring 220 has a projection 222 sized, configured, and located for engaging receipt in the groove 214.

A housing 230 encompasses the load ring 220 and has a lower end 232 with interior threading 234. Wrench flats 236 project from the housing 230.

The housing 230 is threadedly connected to an item (any disclosed herein) beneath the housing 230. As shown, the item is an upper internal blowout preventer 240 (shown partially) with an upper end 242 with exterior threading 244 that threadedly mates with the threading 234 of the housing 230.

The general configuration of the system 200 results in a relative increase in strength as compared to a typical connection with a threaded stem. Stress on the stem is reduced due, e.g., to the large radius of the lower fillet 218. The threading on the housing 230 and on the item below it (e.g. the IBOP 240) are easily inspected and the housing 230 and ring 220 are relatively easy to remove and replace.

Figure 8:
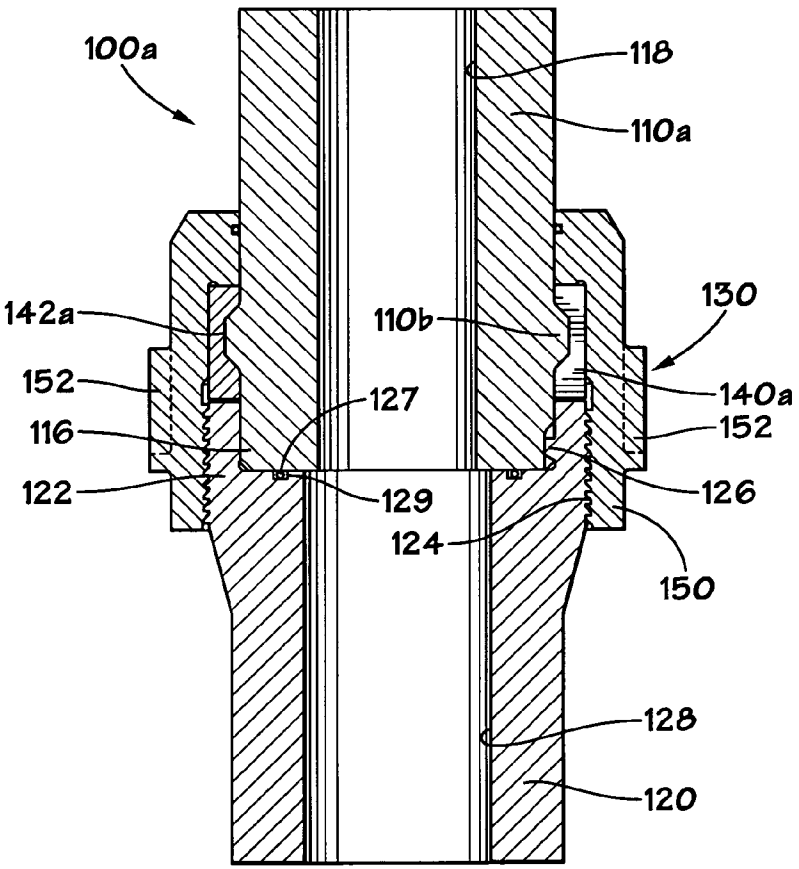
FIG. 8 is a side cross-section view of a connection according to the present invention.

FIG. 8 illustrates a system 100*a* according to the present invention like the system 100 in FIG. 2A (like numerals indicate like parts).

The system 200 has a drill stem 110*a* (driven by a motor of, e.g., a top drive) non-threadedly connected to an upper internal blowout preventer 120 with a connection assembly 130*a* that has a load ring 140*a* and a load ring housing 150. The load ring 140*a* includes, in one aspect, two halves (e.g. like the halves 140*a*, 140*b* but with a projection as described below).

The drill stem 110*a*, which may be any suitable length, has a lower end 112. A series of spaced-apart splines 116 project out from the lower end 112 of the drill stem 110*a*. A fluid flow bore 118 extends from the top to the bottom of the drill stem 110*a*.

The load ring 140*a* has a recess 142*a*. A circumferential projection 110*b* of the drill stem 110*a* projects into the recess 142*a*. Optionally, instead of a complete circumferential projection 110*b*, one, two or more spaced-apart load member projections of sufficient size and mass may be used; and/or with spaced-apart projections instead of a ring only a corresponding load member recess (or recesses) are provided.

The projection 110*b* is held in the recess 142*a* by the load ring housing 150 which has interior threads 152 for threadedly mating with the threads 124 of the upper internal blowout preventer 120 to connect the load ring housing 150 to the upper internal blowout preventer 120 and to maintain the load ring 140 in place.

Loads below the drill stem 110*a* are transferred to the load ring housing 150, from it to the load ring 140*a*, and from the load ring 140*a* to the drill stem 110*a*, thus bypassing a lower part of the drill stem 110*a*. A bore 158 extends through the load ring housing 150 to accommodate the drill stem 110. Wrench flats 152 project out from the housing 150. FIG. 8 is not to scale. The internal diameter (and total mass) of the load ring housing 150 may be increased as needed for strength with a corresponding increase in load ring size.

In certain aspects when assembled a drive stem connected to a lower item (e.g. an internal blowout prevent) is maintained in a condition so that a seal (or seals) sealing the stem/item interface is maintained in sealing contact. Due to the weight that a drill stem will support, this preload is provided, e.g., by a threaded connection between a load ring housing and an internal blowout preventer. In certain aspects, to maintain sealing, a preload force is greater than the sum of the maximum vertical load to be imposed on the stem and the separating force due to the pressure of fluid that will flow through the stem forcing the stem apart from an item, e.g. an internal blowout preventer. In one aspect, a wrench is used to engage the lug protrusions (wrench flats) on the load ring housing holding it stationary, while the drive stem is rotated by drive motor(s) to make up the connection to the required preload. Optionally bolts and corresponding holes on the two apparatuses are used to apply the preload or an hydraulic ram is applied and keeper key(s) are inserted to hold the two apparatuses together under the preload.

The present invention, therefore, in at least certain embodiments, provides a drive system for wellbore operations, the drive system including: a main body; a motor apparatus; a main shaft extending from the main body and rotatable by the motor, the main shaft having a top end and a bottom end; and an item, the item adjacent to the bottom end of the main shaft and non-threadedly connected to the main shaft. Such a system may have one or some, in any possible combination, of the following: a connection assembly for non-threadedly connecting the main shaft to the item, the connection assembly having a load ring with a projection projecting interiorly thereof, a load ring housing, the main shaft having a recess therearound corresponding to the load ring's projection, the projection disposed within the recess, and the load ring housing connectable to an item below the main shaft and the load ring housing adjacent and encompassing the load ring to maintain the load ring in position with respect to the main shaft; wherein the drive system is a top drive system, and the main shaft is a drive stem of the top drive system; wherein the main shaft has an outer surface, the recess has an interior wall, a lower fillet extends from the interior wall to the outer surface of the main shaft, and the lower fillet located for supporting the item and additional things connected to the item; wherein the item includes a drill string; wherein the load ring housing has a series of spaced-apart wrench flats for facilitating rotation of the load ring housing; wherein the load ring housing has a lower end with interior threading for threadedly mating with exterior threading of the item; wherein the load ring is comprised of a plurality of at least two segments installable around and in contact with the main shaft; a series of spaced-apart torque transmitting splines on the lower end of the main shaft for engaging a series of corresponding splines on an interior of the item; wherein the load ring housing has a lower end with interior threading for threadedly mating with exterior threads of the item; wherein the load ring is comprised of a plurality of at least two segments installable around and in contact with the main shaft; a series of spaced-apart torque transmitting splines on the lower end of the main shaft for engaging a series of corresponding splines on an interior of the item; wherein the bottom end of the main shaft is not threaded; and/or wherein the main shaft has a longitudinal axis and a bottom surface at the bottom end, the bottom surface normal to the longitudinal axis of the main shaft, one of the main shaft and the item has a seal recess and an end seal partially disposed in the seal recess, and the end seal for sealing an interface between the main shaft and the item.

The present invention, therefore, provides in at least some, but not necessarily all, embodiments a top drive system for wellbore operations, the top drive system having: a main body; a motor apparatus; a main shaft extending from the main body and rotatable by the motor, the main shaft having a top end and a bottom end; an item, the item non-threadedly connected to the main shaft, the item having an end with exterior threading; a connection assembly for non-threadedly connecting the main shaft to the item; and a series of spaced-apart torque transmitting splines on the lower end of the main shaft for engaging a series of corresponding splines on the item.

The present invention, therefore, in at least certain embodiments, provides a method for connecting a drive shaft of a wellbore operations drive system to an item, the method including: positioning the drive shaft of a drive system above an item, the drive system comprising a main body, a motor apparatus, a main shaft extending from the main body and rotatable by the motor, the main shaft having a top end and a bottom end, and an item, the item non-threadedly connectable to the main shaft; and connecting the drive shaft non-threadedly to the item. Such a system may have one or some, in any possible combination, of the following: wherein the drive system is a top drive system and the drive shaft is a top drive stem; wherein the drive system includes a connection assembly for non-threadedly connecting the drive shaft to the item, the connection assembly having a load ring with a projection projecting interiorly of the load ring, a load ring housing, the main shaft having a recess therearound corresponding to the load ring's projection, the projection disposed within the recess, the load ring housing threadedly connectable to an item below the drive shaft and adjacent the load ring to maintain the load ring in position with respect to the drive shaft, the method further including inserting the bottom end of the drive shaft into the item, placing the load ring around the drive shaft with the projection in the recess, placing the load ring housing over the load ring, and connecting the load ring housing to the item; wherein the main shaft has a series of spaced-apart torque transmitting splines on the lower end of the main shaft, and the item has a corresponding series of splines on an interior thereof, the method further including transmitting torque from the main shaft through the series of torque transmitting splines on the lower end of the main shaft, through the corresponding series of splines on an interior of the item, to the item; wherein the drive shaft has a longitudinal axis and shaft fluid bore therethrough for the flow of fluid through the drive shaft, the item has an item fluid bore therethrough for the flow of fluid through the item, the shaft fluid bore in fluid communication with the item fluid bore, the drive shaft has a bottom surface at the bottom end, the bottom surface normal to the longitudinal axis of the drive shaft, the item has a seal recess and an end seal partially disposed in the seal recess, the end seal sealingly contacting the bottom surface of the main shaft, the drive shaft bottom end interfacing the item at a shaft-item interface, the method further including preventing leakage of fluid past the shaft-item interface with the seal; and/or maintaining a preload on the driveshaft and the item to maintain the seal in sealing contact with the drive shaft.

The present invention, therefore, in at least certain embodiments, provides a top drive shaft useful in wellbore operations, the top drive shaft having: a body having a bottom, a top, an exterior, and a fluid flow bore therethrough from top to bottom; a load recess in the exterior of the body; and the load recess disposed for reception of a load member releasably securable in the load recess.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes.

What is claimed is:

1. A drive system for wellbore operations, the drive system comprising a main body, a motor apparatus, a main shaft extending from the main body and rotatable by the motor, the main shaft having a top end and a bottom end, a connection assembly, an item, the item adjacent to the bottom end of the main shaft and connected to the main shaft with the connection assembly, the connection assembly non-threadedly connecting the main shaft to the item, the connection assembly comprising a load ring with a projection projecting interiorly thereof, a load ring housing, the main shaft having a recess therearound corresponding to the load ring's projection, the projection disposed within the recess, and the load ring housing connectible to an item below the main shaft and the load ring housing adjacent and encompassing the load ring to maintain the load ring in position with respect to the main shaft.

2. The drive system for wellbore operations of claim 1 wherein the drive system is a top drive system, and the main shaft is a drive stem of the top drive system.

3. The drive system of claim 1 wherein the main shaft has an outer surface, the recess has an interior wall, a lower fillet extends from the interior wall to the outer surface of the main shaft, and the lower fillet located for supporting the item and additional things connected to the item.

4. The drive system of claim 1 wherein the item includes a drill string.

5. The drive system of claim 1 wherein the load ring housing has a series of spaced-apart wrench flats for facilitating rotation of the load ring housing.

6. The drive system of claim 1 wherein the load ring housing has a lower end with interior threading for threadedly mating with exterior threading of the item.

7. The drive system of claim 1 wherein the load ring is comprised of a plurality of at least two segments installable around and in contact with the main shaft.

8. The drive system of claim 1 further comprising a series of spaced-apart torque transmitting splines on the lower end of the main shaft for engaging a series of corresponding splines on an interior of the item.

9. The drive system of claim 1 wherein the load ring housing has a lower end with interior threading for threadedly mating with exterior threads of the item.

10. The drive system of claim 1 wherein the load ring is comprised of a plurality of at least two segments installable around and in contact with the main shaft.

11. The drive system of claim 1 further comprising a series of spaced-apart torque transmitting splines on the lower end of the main shaft for engaging a series of corresponding splines on an interior of the item.

12. The drive system of claim 1 wherein the bottom end of the main shaft is not threaded.

13. The drive system of claim 1 wherein the main shaft has a longitudinal axis and a bottom surface at the bottom end, the bottom surface normal to the longitudinal axis of the main shaft, one of the main shaft and the item has a seal recess and an end seal partially disposed in the seal recess, and the end seal for sealing an interface between the main shaft and the item.

* * * * *